US009222234B2

(12) United States Patent
Hyder et al.

(10) Patent No.: US 9,222,234 B2
(45) Date of Patent: Dec. 29, 2015

(54) SUPPORTING STRUCTURE FOR EXCAVATOR

(71) Applicant: Yanmar Co., Ltd., Osaka (JP)

(72) Inventors: Jarrod Hyder, Adairsville, GA (US); Kazuyuki Kotani, Osaka (JP)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 14/319,950

(22) Filed: Jun. 30, 2014

(65) Prior Publication Data

US 2015/0110591 A1 Apr. 23, 2015

Related U.S. Application Data

(60) Provisional application No. 61/892,567, filed on Oct. 18, 2013.

(51) Int. Cl.

| | |
|---|---|
| ***E02F 3/627*** | (2006.01) |
| ***E02F 3/36*** | (2006.01) |
| ***E02F 3/38*** | (2006.01) |

(52) U.S. Cl.

CPC ..... *E02F 3/3631* (2013.01); *E02F 3/3686* (2013.01); *E02F 3/382* (2013.01); *E02F 3/627* (2013.01)

(58) Field of Classification Search

CPC ..... E02F 3/369; E02F 3/3695; E02F 3/382; E02F 3/627; E02F 3/3631; E02F 3/3686

USPC ..... 414/686, 718

See application file for complete search history.

(56) References Cited

U.S. PATENT DOCUMENTS

| | | | | |
|---|---|---|---|---|
| 2,820,558 | A * | 1/1958 | Miller | 414/704 |
| 3,771,677 | A * | 11/1973 | Pilch | 414/688 |
| 4,661,036 | A * | 4/1987 | Horsch | 414/686 |
| 4,746,254 | A * | 5/1988 | Langenfeld et al. | 414/703 |
| 5,540,289 | A * | 7/1996 | Hirooka et al. | 172/274 |
| 7,331,749 | B2 * | 2/2008 | Vachon | 414/694 |
| 2008/0025830 | A1 * | 1/2008 | Pielmeier et al. | 414/723 |

FOREIGN PATENT DOCUMENTS

JP 2010-071054 A 4/2012

* cited by examiner

*Primary Examiner* — Dean Kramer

(74) *Attorney, Agent, or Firm* — Sterne, Kessler, Goldstein & Fox PLLC

(57) ABSTRACT

For providing a supporting structure for the excavator changes the fitting height of the backhoe, This invention provides a supporting structure of excavator for attaching the backhoe with variable height which comprising: an attachment mount fixed to a frame, and an adjuster plate fixed to the attachment mount, wherein the backhoe is mounted to an appropriate position of the adjuster plate.

2 Claims, 5 Drawing Sheets

(4A)

(4B)

SUPPORTING STRUCTURE FOR EXCAVATOR

CROSS-REFERENCE TO RELATED APPLICATIONS

This application claims the benefit of U.S. Provisional Application No. 61/892,567, filed on Oct. 18, 2013, which is incorporated by reference in its entirety.

BACKGROUND OF THE INVENTION

1. Field of the Invention

This invention relates a supporting structure of excavator.

2. Background Art

Conventionally, a tractor with an excavator to the rear portion is known. Such a tractor has a support structure of the backhoe. A general structure of a supporting structure is designed to have an attachment mount on the frame and to fix the excavator on the attachment mount (for example, see JP 2010-71054 A).

By the way, the tractors have different ground clearances (the distance between the lowest portion of the vehicle body from the ground surface on tires) in accordance with their spec. By adopting the same supporting structure regardless of the spec of the tractor, there may need to change the design of the excavator in each spec. On the contrary, by adopting the same excavator there may need to change the design of the supporting structure in each spec. Accordingly, those tractors have problem which increases numbers of process and the cost. Therefore, the supporting structure which changes the fitting height for the excavator is required.

BRIEF SUMMARY OF THE INVENTION

Embodiments described herein aim at providing a supporting structure for the excavator changes the fitting height of the backhoe.

In one embodiment, a supporting structure of excavator for attaching the backhoe with variable height is disclosed comprising: an attachment mount fixed to a frame, andan adjuster plate fixed to the attachment mount, wherein the backhoe is mounted to an appropriate position of the adjuster plate.

In one embodiment, a through hole is formed in the joint plate of the backhoe, a plurality of through holes corresponding to the through hole of the joint plate is formed in the adjuster plate, and the backhoe is mounted to an appropriate position of the adjuster plate by inserting a bolt through the through hole of the joint plate and one of the through holes of the adjuster plate overlapping one another.

In one embodiment, a pin is disposed on a side surface of the attachment mount, a hook is formed in a lower edge portions of the adjuster plate, and the adjuster plate is fixed to the attachment mount with the hook of the adjuster plate hooked on the pins of the attachment mount.

Advantageous Effects

In one embodiment, the attachment mount fixed to the frame is equipped. The adjuster plate fixed to the attachment mount is also equipped. And the backhoe is mounted to an appropriate position of the adjuster plate. Therefore, even when the specs of the tractors are different, it is possible to common supporting structure of the excavator and the excavator and to solve the problems increasing process steps and the cost.

In one embodiment, the through hole is formed in the joint plate 68 of the backhoe. A plurality of through holes corresponding to the through hole of the joint plate is formed in the adjuster plate. And the backhoe is mounted to an appropriate position of the adjuster plate by inserting a bolt through the through hole of the joint plate and one of the through holes of the adjuster plate overlapping one another. Therefore, it makes change the fitting height for the excavator is required. Setting the through holes for each spec of tractors, assembling process becomes easier and the productivity is increased.

BRIEF DESCRIPTION OF THE DRAWINGS/FIGURES

DETAILED DESCRIPTION OF THE INVENTION

First, a tractor 100 is briefly described. A supporting structure 7 according to the present invention can be applied to vehicles other than tractors.

Figure 1:
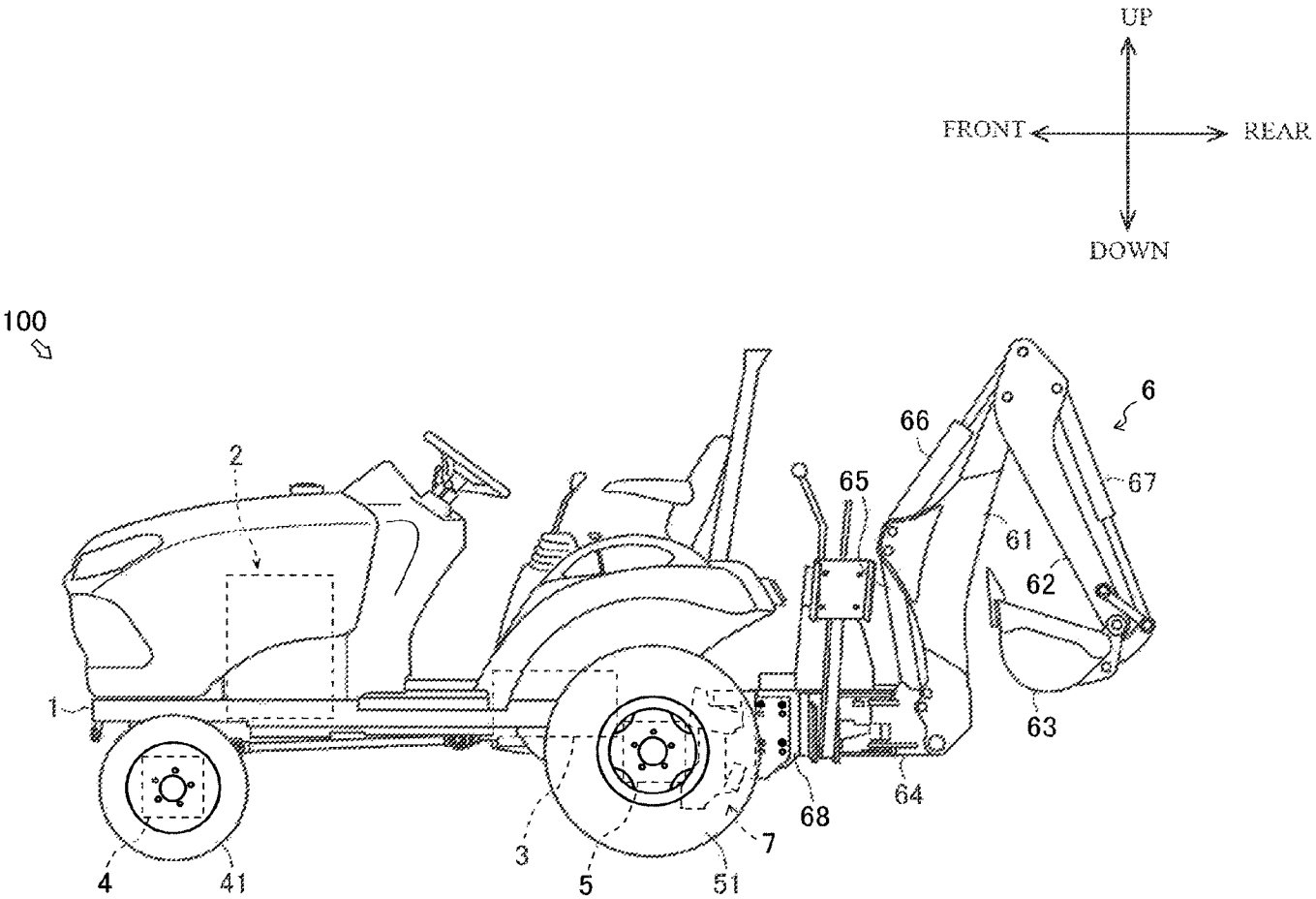
FIG. 1 is a diagram showing a tractor.

FIG. 1 shows the tractor 100. In the figure, the front and rear direction and the upper and lower direction of the tractor 100 are indicated.

The tractor 100 mainly includes a frame 1, an engine 2, a transmission 3, a front axle 4, and a rear axle 5. The tractor 100 further includes a backhoe 6.

The frame 1 serves as the main structure for the tractor 100. The engine 2 and the like described below are attached to the frame 1.

The engine 2 converts energy obtained by burning a fuel into rotational movement. When an operator operates an acceleration lever, the engine 2 changes the driving state in accordance with the operation. The engine 2 maintains the rotational speed at a constant level even when the load changes.

The transmission 3 switches between forward and backward movement of the tractor 100 and shifts the speed of the tractor 100. When the operator operates a shift lever, the operation state of the transmission 3 changes in accordance with the operation. The transmission 3 includes a hydromechanical continuously variable transmission (HMT or I-HMT) as a transmission device.

The front axle 4 transmits the rotational energy from the engine 2 to front tires 41. The rotational energy from the engine 2 is input to the front axle 4 through the transmission 3. The front axle 4 is disposed next to a steering device. When the operator operates a handle, the steering device changes a steering angle of the front tires 41 in accordance with the operation.

The rear axle 5 transmits the rotational energy from the engine 2 to rear tires 51. The rotational energy from the engine 2 is input to the rear axle 5 through the transmission 3. The rear axle 5 is provided with a PTO output mechanism. If a rotary tiller or the like is mounted instead of the backhoe 6, the PTO output mechanism inputs the rotational energy to the rotary tiller and the like.

The backhoe 6 is used for excavating the soil and the like. A hydraulic oil is supplied to the backhoe 6 through a hydraulic circuit not shown. The backhoe 6 is coupled to the frame 1 through the supporting structure 7. The backhoe 6 and the supporting structure 7 for the backhoe 6 are described in detail below.

First, the supporting structure 7 for the backhoe 6 will be described.

Figure 2:
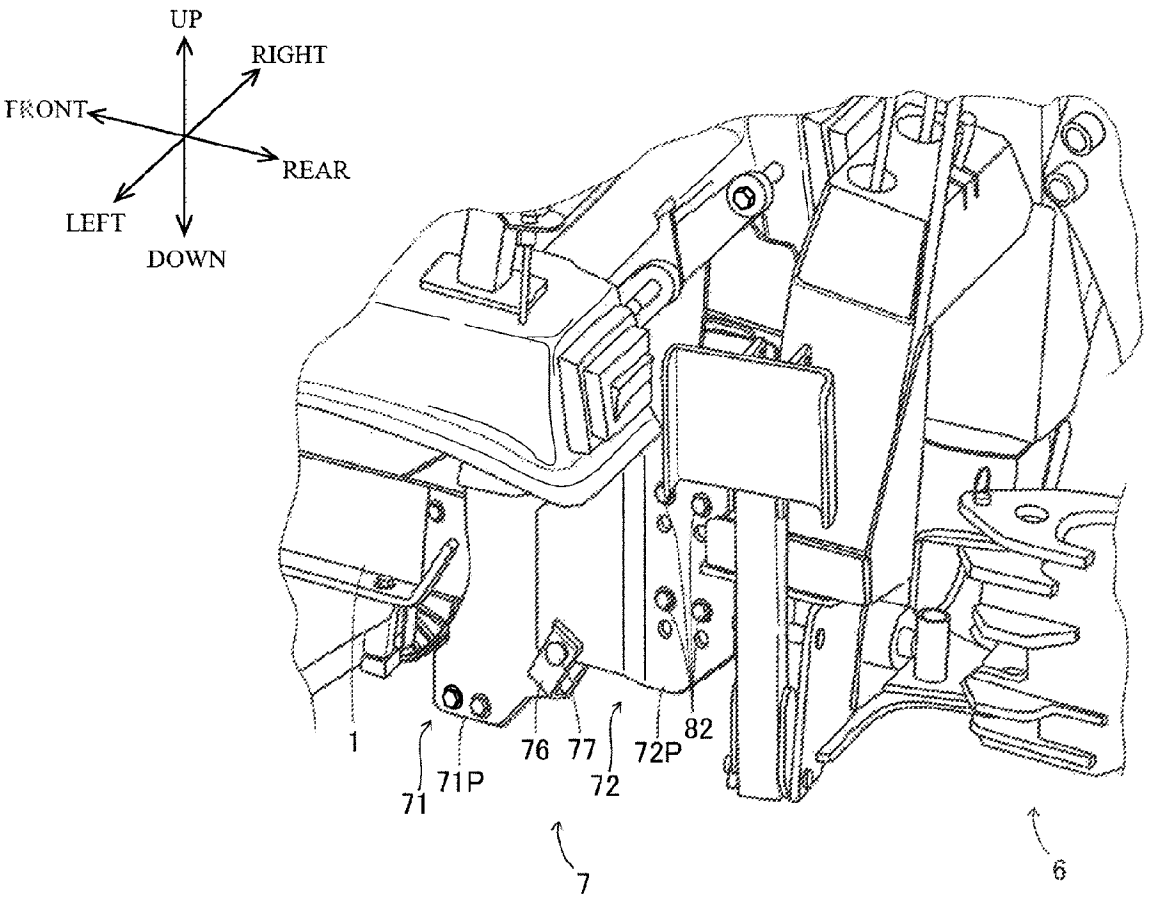
FIG. 2 is a diagram showing a supporting structure for a backhoe.
Figure 3:
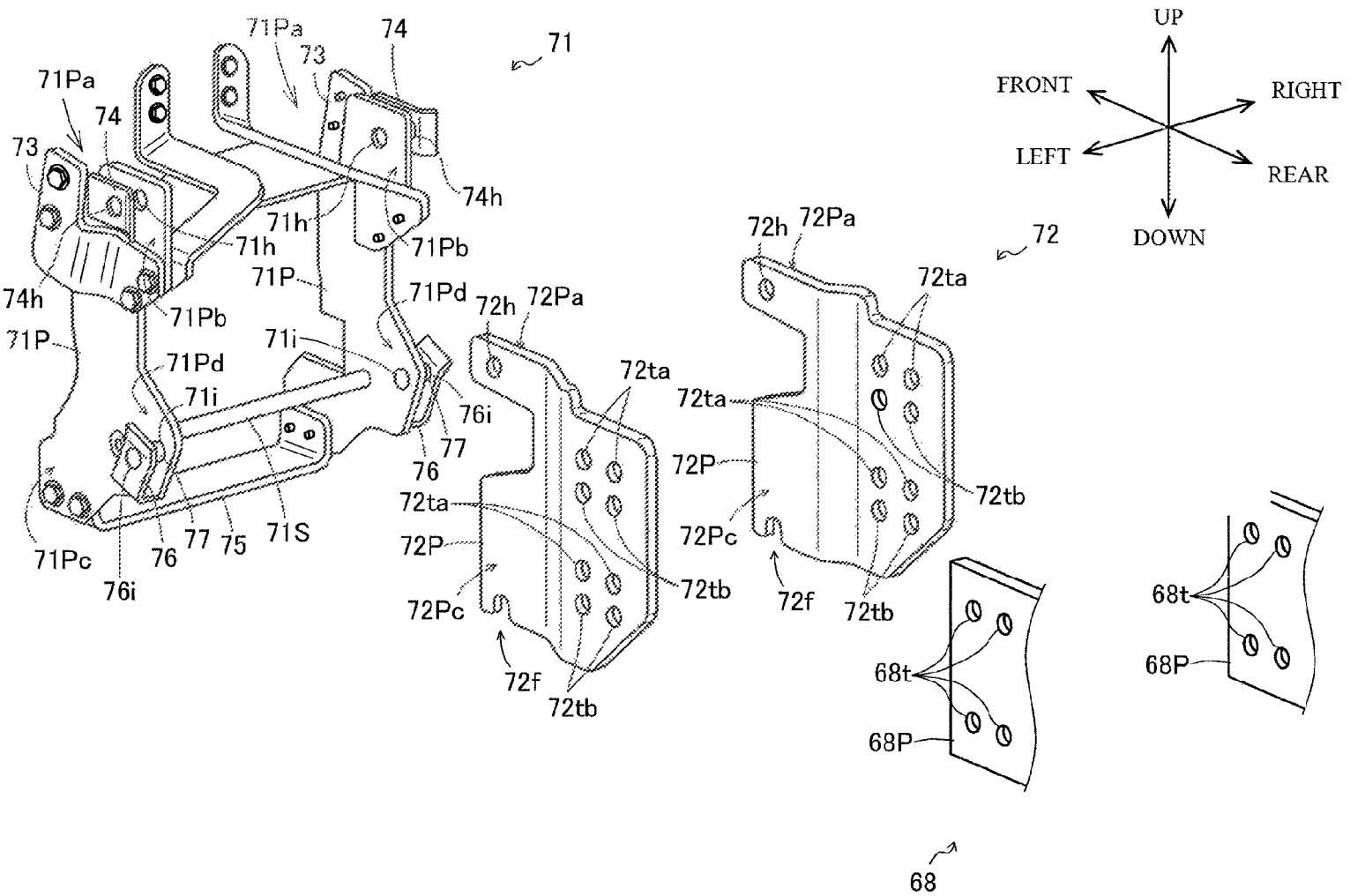
FIG. 3 is a diagram showing an attachment mount and an adjuster plate.

FIG. 2 shows the supporting structure 7 for the backhoe 6. FIG. 3 shows an attachment mount 71 and an adjuster plate 72, as well as a joint plate 68 of the backhoe 6. In the figure, the front and rear direction, the left and right direction, and the upper and lower direction of the tractor 100 are indicated.

The attachment mount 71 mainly includes two plate members 71P. One plate member 71P is arranged in parallel with the other plate member 71P and the plate members 71P each have a front end portion attached to the frame 1. Thus, the attachment mount 71 is fixed to the frame 1. The attachment mount 71 includes a link shaft 71S having both end portions supported by the two plate members 71P.

When the attachment mount 71 is fixed to the frame 1, the plate members 71P of the attachment mount 71 are in parallel with the front and rear direction and the upper and lower direction, and thus are perpendicular to the left and right direction.

A lack portion 71Pa where the plate member 71P lacks a front portion is formed in an upper portion of the plate member 71P. The lack portion 71Pa is disposed so as not to interfere with a ROPS 11 (see FIGS. 4 and 5). An upper plate 73 to come into contact with the ROPS 11 is attached to a bracket portion 71Pb described later. The plate member 71P is also fixed to the ROPS 11 via the upper plate 73 (see FIGS. 4 and 5).

The bracket portion 71Pb extending backward is formed in the upper portion of the plate member 71P. A shaft hole 71*h* is formed in the bracket portion 71Pb. An upper guide 74 in parallel with the bracket portion 71Pb is attached to the bracket portion 71Pb. The upper guide 74 is also provided with a shaft hole 74*h*. The shaft holes 71*h* and 74*h* are formed in such a manner as to be capable of receiving a lock pin 81 (see FIGS. 4 and 5). An end portion of the upper guide portion 74 is bent outward so that a bracket portion 72Pa described later is able to be received.

A bracket portion 71Pc extending forward is formed it a lower portion of the plate member 71P. The bracket portion 71Pc is formed to have a lower end positioned lower than the rear axle 5 (see FIG. 1). A lower plate 75 extending below the rear axle 5 is attached to the bracket portion 71Pc. The plate member 71P is coupled to the other plate member 71P through the lower plate 75.

A bracket portion 71Pd extending backward is formed in a lower portion of the plate member 71P. The bracket portion 71Pd is provided with a shaft hole 71*i*. A lower guide 76 in parallel with the bracket portion 71Pd is attached to the bracket portion 71Pd. The lower guide 76 is also provided with a shaft hole 76*i*. A pin 77 is inserted in the shaft holes 71*i* and 76*i* to have both ends supported. An end portion of the lower guide 76 is bent outward so that a bracket portion 72Pc described later is able to be received.

The adjuster plate 72 includes a pair of two plate members 72P. One plate member 72P is arranged in parallel with the other plate member 72P and the plate members 72P each have a front end portion attached to the plate member 71P. Thus, the adjuster plate 72 is fixed to the attachment mount 71. The shapes of the plate members 72P are symmetrical with one another.

When the adjuster plate 72 is fixed to the attachment mount 71, the plate members 72P of the adjuster plate 72 are parallel with the front and rear direction and the upper and lower direction, and thus are perpendicular to the left and right direction.

A bracket portion 72Pa extending forward is formed in an upper portion of the plate member 72P. The bracket portion 72Pa has such a thickness to be capable of being inserted between the plate member 71P (bracket portion 71Pb) and the upper guide 74 without largely rattling. The bracket portion 72Pa is provided with a shaft hole 72*h* formed in such a manner that the lock pin 81 can be inserted therethrough (see FIGS. 4 and 5).

A bracket portion 72Pc extending forward is formed in a lower portion of the plate member 72P. The bracket portion 72Pc has such a thickness to be capable of being inserted between the plate member 71P (bracket portion 71Pd) and the lower guide 76 without largely rattling. The bracket portion 72Pc is provided with a hook 72*f* formed to be capable of being hooked on the pin 77 (see FIGS. 2, 4, and 5).

The plate member 72P is provided with a total of eight shaft holes in two rows and four stages. Here, a total of four shaft holes in the first and the third stages from the upper side are defined as "through hole 72*ta*", whereas a total of four shaft holes in the second and the fourth stages from the upper side are defined as "through hole 72*tb*". The through holes 72*ta* and 72*tb* are formed in such a manner that a bolt 82 can be inserted therethrough (see FIGS. 2 and 5). In the supporting structure 7, a total of eight through holes 72*ta* and 72*tb* in two rows and four stages are formed. Alternatively, for example, a total of twelve through holes in two rows and six stages may be formed.

Next, the backhoe 6 will be described.

The backhoe 6 mainly includes a boom 61, an arm 62, and a bucket 63 (see FIG. 1). The boom 61 has one end supported by a boom bracket 64, and is rotated by a boom cylinder 65 movable to extend and contract. The arm 62 has one end supported by the boom 61, and is rotated by an arm cylinder 66 movable to extend and contract. The bucket 63 has one end supported by the arm 62, and is rotated by a bucket cylinder 67 movable to extend and contract. The boom bracket 64 is supported by a joint plate 68.

The joint plate 68 includes a pair of two plate members 68P. One plate member 68P is arranged in parallel with the other plate member 68P and the plate members 68P each have a front end portion attached to the plate member 72P. Thus, the joint plate 68 is fixed to the adjuster plate 72. The shapes of the plate members 68P are symmetrical with one another.

When the joint plate 68 is fixed to the adjuster plate 72, the plate members 68P of the joint plate 68 are parallel with the front and rear direction and the upper and lower direction, and thus are perpendicular to the left and right direction.

The plate member 68P is provided with a total of four shaft holes in two rows and two stages. All the shaft holes are defined as "through hole 68*t*". The through hole 68*t* is formed in such a manner that the bolt 82 is able to be inserted therethrough (see FIGS. 2 and 5).

A step for fixing the adjuster plate 72 to the attachment mount 71 is described below.

Figure 4:
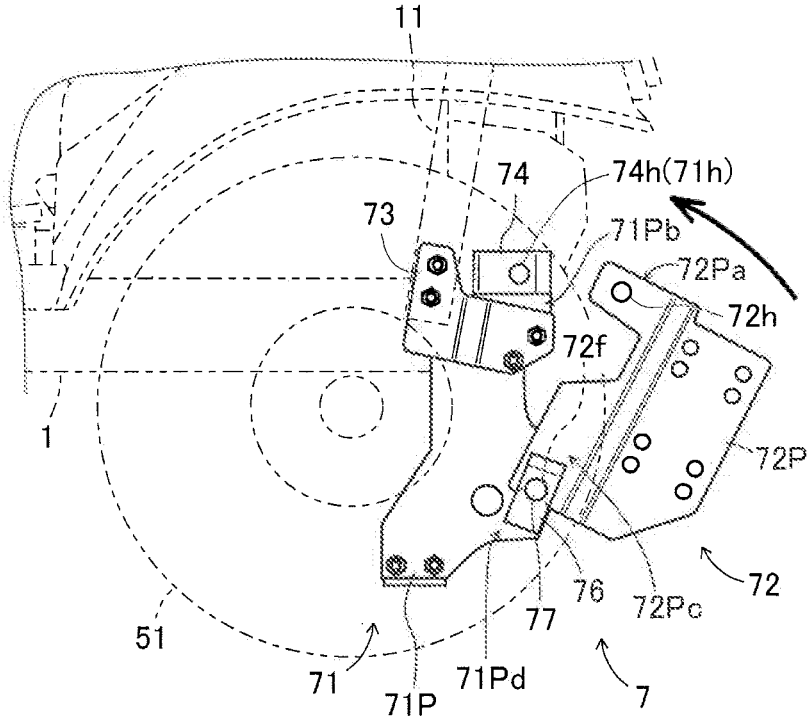
FIGS. 4A and 4B are diagrams showing a step for fixing the adjuster plate to the attachment mount.
Figure 4:
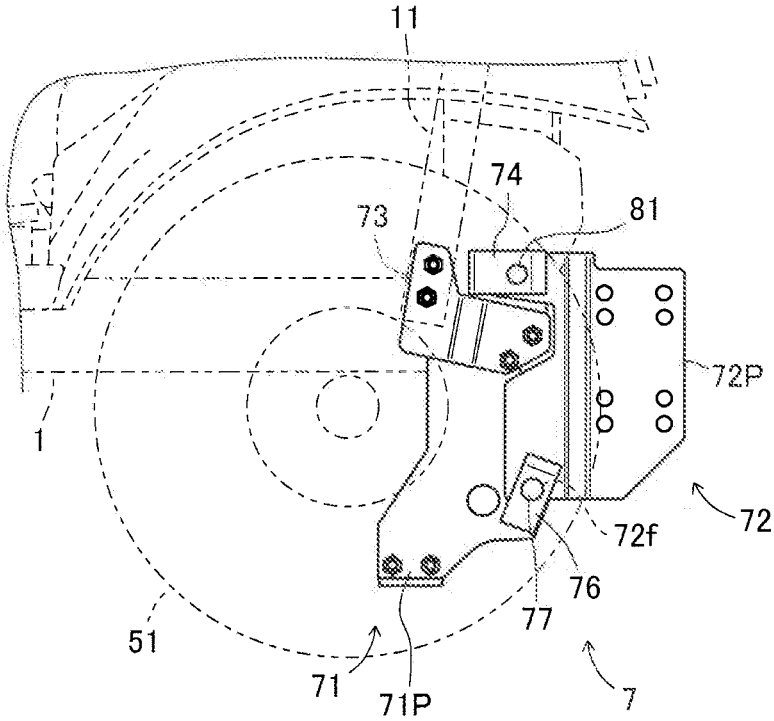
Figure 5:
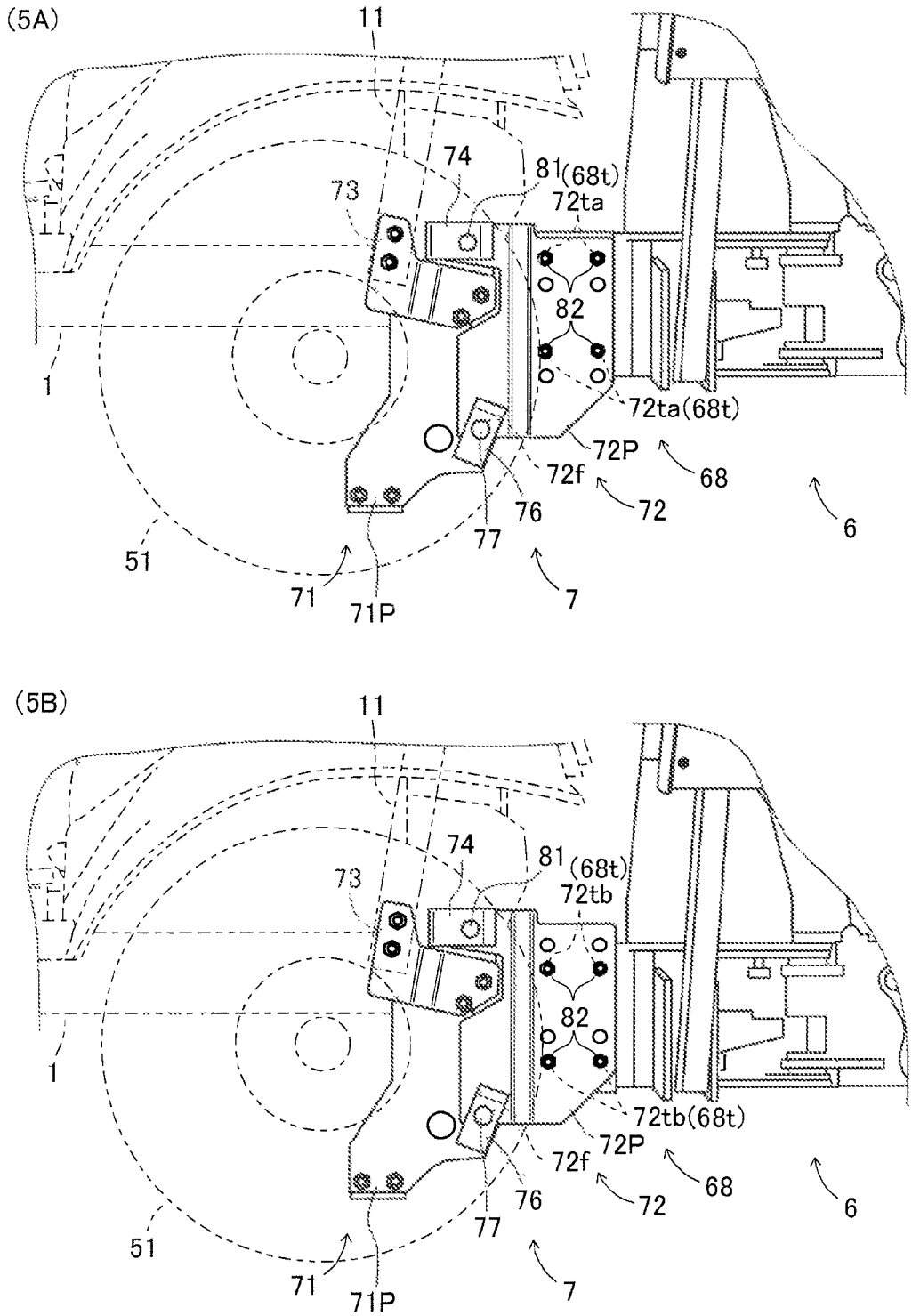
FIGS. 5A and 5B are diagrams showing a step of mounting the backhoe to an appropriate position of the adjuster plate.

FIG. 4 shows the step for fixing the adjuster plate 72 to the attachment mount 71, and more specifically shows a step for attaching the plate member 72P to the plate member 71P.

First, the operator uses a crane and the like to lift the adjuster plate 72. Then, the operator inserts the bracket portion 72Pc between the plate member 71P (bracket portion 71Pd) and the lower guide 76, and hooks the hook 72*f* on the pin 77 (see FIG. 4A). Then, the operator rotates the plate member 72P so that the bracket portion 72Pa is inserted between the plate member 71P (bracket portion 71Pb) and the upper guide 74. The operator overlaps the shaft hole 72*h* on the shaft holes 71*h* and 74*h*. Finally, the operator inserts the lock pin 81 into the shaft holes 71*h*, 72*h*, and 74*h* (see FIG. 4B). Thus, the plate member 72P is attached on the plate member 71P. Thus, the adjuster plate 72 is fixed to the attachment mount 71.

Technical features of the present invention described above are summarized as follows.

As a first feature, the supporting structure 7 includes the attachment mount 71 to be fixed to the frame 1. The supporting structure 7 further includes the adjuster plate 72 to be fixed to the attachment mount 71. The backhoe 6 is mounted to an appropriate position of the adjuster plate 72.

Thus, the attachment height of the backhoe 6 can be appropriately changed. Therefore, the backhoe 6 and the supporting structure 7 for the backhoe 6 can be shared between the tractors 100 of different types. Thus, a problem of increase in designing steps and cost can be solved.

As a second feature, for the supporting structure 7, the through hole 68*t* is formed in the joint plate 68 of the backhoe 6. The supporting structure 7 has, in the adjuster plate 72, a plurality of through holes 72*ta* and 72*tb* corresponding to the through hole 68*t* of the joint plate 68. The bolt 82 is inserted through the through hole 68*t* of the joint plate 68 and one of the through holes 72*ta* and 72*tb* of the adjuster plate 72 overlapping one another. Thus, the backhoe 6 is mounted to an appropriate position of the adjuster plate 72.

Thus, the attachment height of the backhoe 6 can be changed in stages (in two stages in the supporting structure 7). Thus, by determining the through hole 72*ta* or 72*tb* through which the bolt 82 is inserted in accordance with the type of the tractor 100, the assembly process is facilitated, whereby the productivity is improved.

As a third feature, in the supporting structure 7, the pins 77 are disposed on the side surfaces of the attachment mount 71. In the supporting structure 7, the hooks 72*f* are formed in the lower edge portions of the adjuster plate 72. The adjuster plate 72 is fixed to the attachment mount 71, with the hooks 72*f* of the adjuster plate 72 hooked on the pins 77 of the attachment mount 71.

Thus, a simple structure with a small number of parts is achieved, whereby reduction of the designing steps and the cost is able to be achieved.

What is claimed is:

1. A supporting structure of an excavator for attaching a backhoe with variable height, comprising:

an attachment mount fixed to a frame of the excavator;

an upper guide coupled to the attachment mount, wherein the upper guide is parallel to an upper portion of the attachment mount;

a lower guide coupled to the attachment mount, wherein the lower guide is parallel to a lower portion of the attachment mount;

an adjuster plate inserted and fixed between the attachment mount and the upper guide and between the attachment mount and the lower guide;

a first through hole formed in a joint plate of the backhoe; and a plurality of through holes formed in the adjuster plate, wherein the backhoe is adjustably mounted to the adjuster plate by a bolt through the first through hole of the joint plate and one of the through holes of the adjuster plate overlapping one another.

2. The supporting structure according to the claim 1, wherein:

a pin is disposed on a side surface of the attachment mount;

a hook is formed in a lower edge portion of the adjuster plate; and the adjuster plate is fixed to the attachment mount with the hook of the adjuster plate hooked on the pin of the attachment mount.

* * * * *